US006226800B1

(12) United States Patent
Islar

(10) Patent No.: US 6,226,800 B1
(45) Date of Patent: May 8, 2001

(54) THONGED HOSIERY GARMENT

(76) Inventor: Marcella Islar, 15611 111$^{th}$ Ave., Jamaica, NY (US) 11433

( * ) Notice: Subject to any disclaimer, the term of this patent is extended or adjusted under 35 U.S.C. 154(b) by 0 days.

(21) Appl. No.: 09/559,288

(22) Filed: Apr. 27, 2000

(51) Int. Cl.$^{7}$ ..... A43B 17/00
(52) U.S. Cl. ..... 2/239; 2/409
(58) Field of Search ..... 2/239, 409; 66/178 R, 66/184, 185; 36/8.1, 14, 94, 106, 109, 98, 87, 109 R, 102, 110, 11.57, 1 R, 7.3, 7.4, 4, 10; D2/980

(56) References Cited

U.S. PATENT DOCUMENTS 715,543 * 12/1902 Bosworth ..... 2/239
1,435,047 * 11/1922 von S.S. Blum ..... 2/239
1,798,201 * 3/1931 Hedges ..... 2/239
1,811,786 * 6/1931 Frei ..... 2/409
1,999,929 * 4/1935 Hearn ..... 2/409
2,332,252 * 10/1943 Payne ..... 2/239 X
3,605,122 * 9/1971 Myers .
4,181,982 * 1/1980 Segovia .
5,054,129 * 10/1991 Baehr ..... 2/409
5,623,734 * 4/1997 Pugliatti .
5,749,100 * 5/1998 Rosenberg ..... 2/239
5,867,838 * 2/1999 Corry ..... 2/239
5,906,007 * 5/1999 Roberts .

* cited by examiner

*Primary Examiner*—Gloria M. Hale
(74) *Attorney, Agent, or Firm*—Norris McLaughlin & Marcus

(57) ABSTRACT

A hosiery garment, for example, a stocking, having two openings in a portion thereof that covers the foot of a wearer of the hosiery garment, these two openings in combination defining a thong member, the thong member being selectively positionable between any two toes on the foot of the wearer, and the openings being designed so that, when the hosiery garment is worn, the two openings expose not only the toes of the foot of the wearer, but also other parts of the same foot of the wearer.

5 Claims, 2 Drawing Sheets

THONGED HOSIERY GARMENT

BACKGROUND OF THE INVENTION

1. Field of the Invention

The present invention relates to a hosiery garment, for example, a stocking, having a thong at least in a toe region thereof.

2. Description of Related Art

Appearance is an important aspect when presenting oneself to others. Presentation, including attire, hairstyle, personal hygiene, etc., can influence the way individuals are perceived. For this reason, many consumers strive to acquire and maintain a versatile and stylish wardrobe. All types of apparel from accessories, such as: belts, ties, scarves, and jewelry, to footwear: including sandals, boots, dress shoes, and athletic shoes, can affect one's appearance. For many women that may wear a dress or skirt, hosiery is an important element of the outfit. Hosiery can also be worn with slacks or shorts to provide a flawless, toned, sheer look.

In the United States and most other countries, hosiery refers to stockings, socks, tights, and pantyhose. In Great Britain, hosiery includes machine-knitted garments of all types.

While stockings and socks come in pairs, pantyhose and tights are single garments in which the separate legs of the hose are joined together at the waist hips and seat. Although identical in concept, tights and pantyhose have quite different histories. Tights were originally worn by men, beginning in the late Middle Ages. Noblemen wore tights of silk or velvet, often in bright colors and sometimes with each leg differently colored. Tights are still worn today by dancers and ballet performers. Pantyhose did not enter the hosiery market until the early 1960s. These two-legged items for women quickly replaced pairs of the more cumbersome one-legged stockings that attached to a garter belt.

Pantyhose were originally knit on a "Straight Bar" machine invented in England by William Cotton during 1864. After knitting, they were seamed, because it was impossible to make well fitting pantyhose without a seam at the back. However, since the 1960s, most women prefer pantyhose that are seamless. Seamless stockings are made on a circular machine. The earliest seamless stockings were essentially straight knitted tubes that did not fit as well as the previously produced seamed pantyhose. The tube shape was caused by the fact that circular knitting machines cannot drop stitches to narrow the stocking so that it contours around the legs. The thermoplastic qualities of nylon were used later to form a permanent shape in the tube, thus contributing to a preference for the seamless over the seamed panty hose. The fit of hosiery has since been improved by the adoption of stretch fabrics such as Lycra. A special process changes nylon filaments into a fluffy yarn that stretches. Such fabrics have made possible the manufacture of one-size-fits-all stockings for men and women.

Hosiery garments having openings in a toe region thereof are known. For example, U.S. Pat. Nos. 1,999,929, 3,605,122, 4,181,982, 5,623,734, 5,749,100 and 5,906,007 all describe such structures, mainly for exposing the toes and/or end of the foot for purposes of pedicure, massage or some other treatment. U.S. Pat. No. 5,054,129, likewise discloses a hosiery garment having an opening in the area of the toes, and having the opening joined in two places, thereby creating a double thong effect, which is intended to keep the garment taut on the body, even if the garment gets wet.

None of the known garments has been designed so as to enhance the physical features of the wearer, and, in particular, to accentuate the appearance of the wearer's feet.

SUMMARY OF THE INVENTION

Accordingly, it was an object of the present invention to provide a hosiery garment that would be attractive and exotic, and also accentuate the appearance of the wearer's feet.

This and other objects were met by the present invention, which relates generally to a hosiery garment comprising two openings in a portion thereof which covers a foot of a wearer of said hosiery garment, said two openings in combination defining thong member which is selectively positionable between any two adjacent toes of said foot of said wearer, said hosiery garment having a maximum of one such thong member per foot of said wearer, and, when said hosiery garment is worn by said wearer, said two openings exposing not only the toes of a foot of said wearer on which said hosiery garment is worn, but additionally other parts of the same said foot of said wearer.

The term "hosiery garment" as used herein is intended to embrace any hosiery garment intended to be worn over the foot and at least part of at least one leg of the wearer. The term "hosiery garment" as used herein, thus, includes stockings, socks, tights, and panty hose, etc.

BRIEF DESCRIPTION OF THE DRAWINGS

The invention will now be described in greater detail with reference to the drawings, wherein.

DETAILED DESCRIPTION OF THE INVENTION

Figure 1:
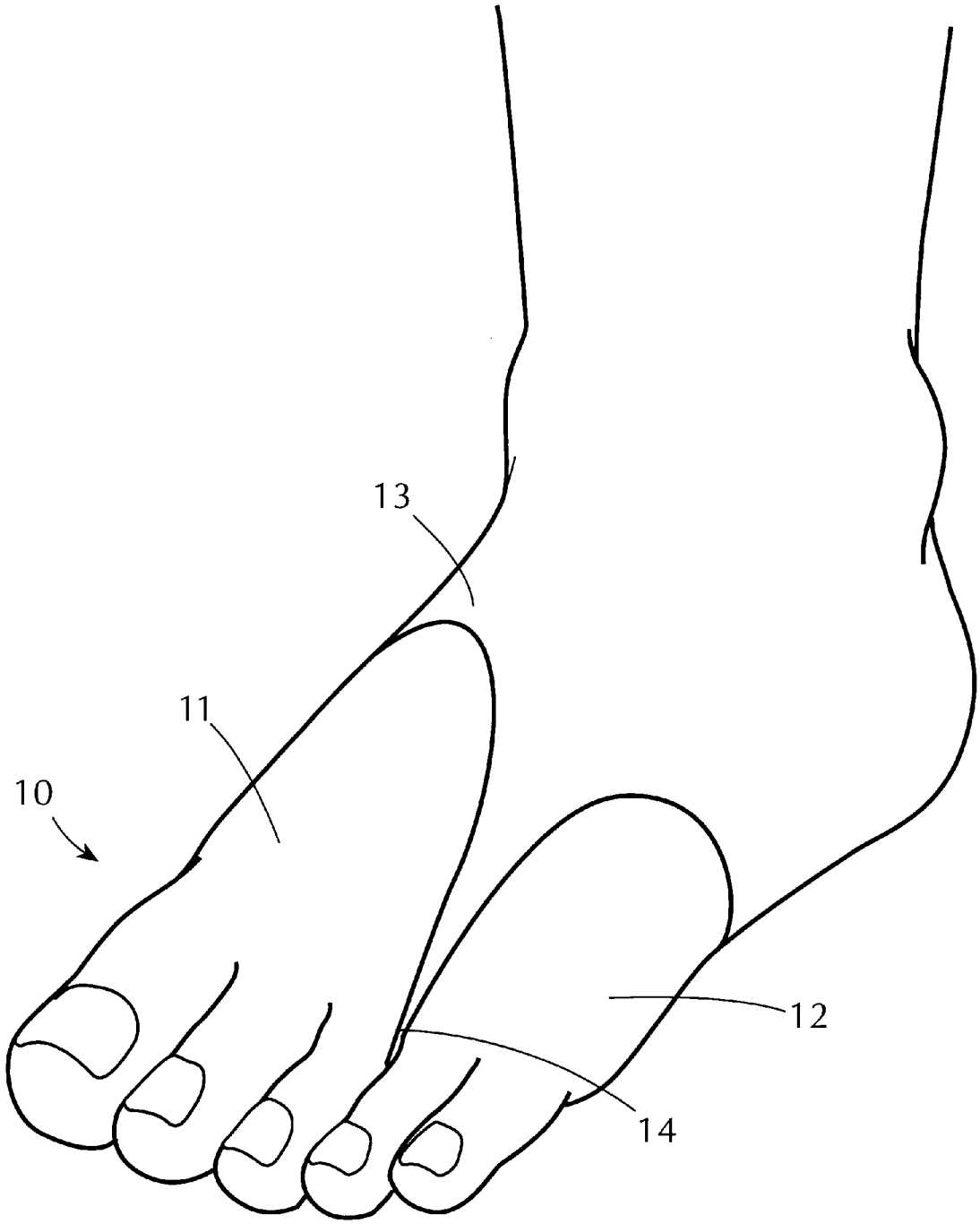
FIG. 1 is a drawing depicting a thonged stocking worn on the left foot of a user, the view being of the top side of the foot of said user.

To illustrate the invention, reference is made to a preferred embodiment, wherein the inventive hosiery garment is a stocking. As can be seen from FIG. 1, the inventive stocking 13 is worn on at least one foot of wearer 10. The inventive stocking has two openings, which, when the stocking is positioned on the foot of the wearer, exposes the toes on that foot, and also upper foot portions 11 and 12, respectively. The two openings also combine to create thong member 14, which is selectively positionable between any two adjacent toes.

Figure 2:
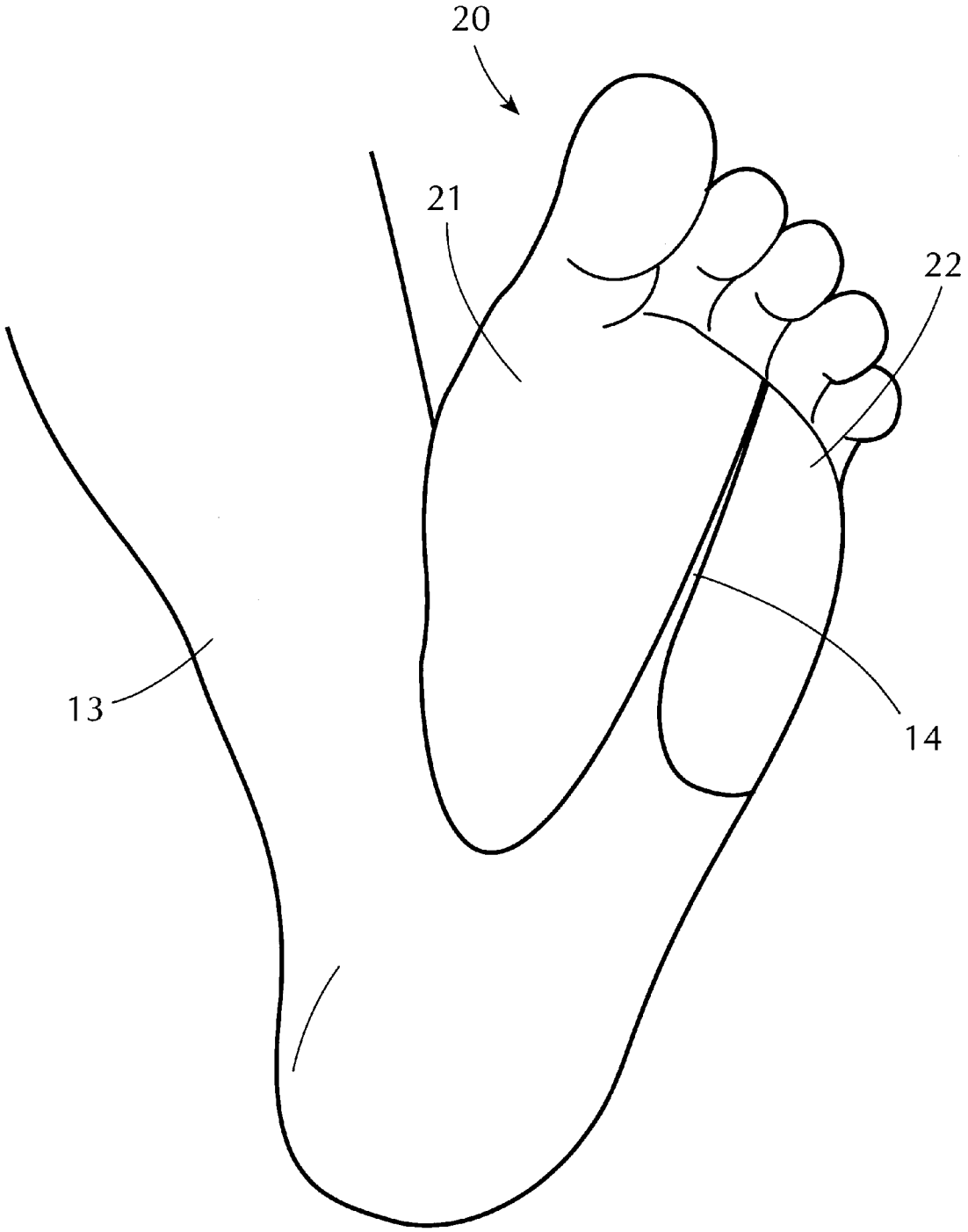
FIG. 2 is a drawing depicting a thonged stocking worn on the left foot of a user, this view being of the underside of the foot of said user.

As can be seen from FIG. 2, it is also possible to design the two openings so that portions of the sole of the foot 21 and 22, respectively, are also exposed when the inventive stocking is worn.

The selective positionability of the inventive stocking is an important attribute, because, depending on whether the thong member is positioned between the first two toes or the last two toes, more or less of the upper and lower portions of the foot of the user will be exposed. Consequently, the ability to choose the point where the thong member will be inserted becomes a means of controlling the amount of the foot of the wearer which will be exposed when the inventive stocking is worn. Thus, for example, the inventive stocking can be designed or positioned so that practically the whole bottom surface of the feet is exposed, while only part of the top of the feet is exposed, which is a good structure for use by dancers, and other variations are likewise also possible.

The inventive stocking can be designed as pantyhose as well as thigh length stockings. Also, the inventive stocking can be designed in a variety of colors and/or textures. Thus, for example, the inventive stocking can be designed as leotards for dancers, as sheer or colored stockings to dress-up an outfit, and in a manner to match costumes for stage actors and/or actresses. Further, when used with lingerie and/or a garter belt, the inventive stocking is highly seductive, exposing, for example, the tops of the feet, while lending a beautiful thong effect on the bottom of the feet.

The inventive stocking can be designed to be unisex, i.e., so that it can be worn by men, women and children, although designs specific for women, men and children are also possible. The inventive stocking can also be worn alone, or, if desired, with shoes, for example, sandals. If the wearer decides to wear the inventive stocking with, for example, a pair of sandals that also inserts between the toes, then the inventive stocking can be positioned in a way that adds uniqueness to the wearer.

In short, the inventive stocking could be worn by any one who enjoys having an attractive, unique and stylish appearance.

In most cases, the inventive stocking will be worn on both feet of the wearer. However, this is not necessary, and it is anticipated that some users will want to accentuate one foot and not the other. Accordingly, one or both feet of the wearer may carry the inventive stocking, as desired.

The inventive stocking can be manufactured by any of the methods which are well known to persons skilled in the art. The technical obstacle to be overcome here was developing the concept for the thonged stocking in the first place. Once that obstacle was overcome, any number of well known methods for manufacturing the inventive stockings immediately become readily apparent to persons skilled in the art.

For example, the inventive stocking can be manufactured in part on the circular knitting machines conventionally used for manufacturing stockings. Since the circular knitting machine is unable to drop or pickup stitches, use can be made of a pattern for the stocking design. Once the stocking is made on the circular knitting machine, the pattern design is then cut into the stocking, and the stocking is sewn with an over edge stitch around the cut design to prevent the stocking from running.

It will be appreciated that what has been described are only exemplary embodiments of the present invention, and that other embodiments will be suggested to persons skilled in the art. It is intended that the present invention includes not only the exemplary embodiments described herein, but also such other embodiments.

What is claimed is:

1. A hosiery garment comprising two openings in a portion thereof which covers a foot of a wearer of said hosiery garment, said two openings in combination defining a thong member which is selectively positionable between any two adjacent toes of said foot of said wearer, said hosiery garment having a maximum of one such thong member per foot of said wearer, and, when said hosiery garment is worn by said wearer, said two openings exposing not only the toes of a foot of said wearer on which said hosiery garment is worn, but additionally a majority of the sole of the same said foot of said wearer.

2. The hosiery garment according to claim 1, which, when worn by said wearer, exposes portions of both a top side and an underside of said foot of said wearer.

3. The hosiery garment according to claim 1, which is a pantyhose garment comprising foot portions intended to be worn over both feet of said wearer, and each foot portion has one said thong member.

4. The hosiery garment according to claim 1, which is a stocking.

5. The hosiery garment according to claim 1, wherein a heel thereof is unopened.

* * * * *